United States Patent [19]

Yokoyama

[11] Patent Number: 4,800,745

[45] Date of Patent: Jan. 31, 1989

[54] SPUR GEAR AUTOMATIC PRODUCTION PROCESS

[75] Inventor: Michihiro Yokoyama, Aichi, Japan

[73] Assignee: Kabushiki Kaisha Yokoyama Seisakusho, Anjo, Japan

[21] Appl. No.: 68,143

[22] Filed: Jun. 30, 1987

[30] Foreign Application Priority Data

Jul. 1, 1986 [JP] Japan ..... 61-154823

[51] Int. Cl.[4] ..... B21D 53/28; B21D 28/02

[52] U.S. Cl. ..... 72/336; 72/339; 72/356; 72/359; 72/361; 29/159.2

[58] Field of Search ..... 72/336, 335, 328, 329, 72/339, 356, 359, 361; 29/159.2

[56] References Cited

U.S. PATENT DOCUMENTS

| | | | |
|---|---|---|---|
| 521,178 | 6/1894 | Porter | 29/159.2 |
| 1,725,300 | 8/1929 | Pierson et al. | 72/328 |
| 2,542,912 | 2/1951 | Ensign | 29/159.2 |
| 3,381,514 | 5/1968 | Schmidt et al. | 72/335 |
| 3,635,067 | 1/1972 | Hanas | 72/329 |

FOREIGN PATENT DOCUMENTS

| | | | |
|---|---|---|---|
| 516674 | 4/1921 | France | 29/159.2 |
| 58-952 | 4/1983 | Japan | 29/159.2 |
| 58-47929 | 10/1983 | Japan . | |
| 37237 | 2/1985 | Japan | 29/159.2 |
| 30251 | 2/1986 | Japan | 29/159.2 |

*Primary Examiner*—Daniel C. Crane

*Attorney, Agent, or Firm*—Burns, Doane, Swecker & Mathis

[57] ABSTRACT

The present invention relates to a spur gear automatic production process wherein spur gears are cold-press formed. The invention provides a top and bottom table with stock fed therebetween in sequential operation with the vertical stroke of the press machine, stamping a disk-shaped gear workpiece by means of top and bottom die sets in the first section which are positioned for integrated movement, thereafter moving said gear workpiece to the second section by means of an unobstructed feed, stamping thereon the tooth profile by means of the vertical stroke of top and bottom die sets positioned in said second section, and ironing said gear workpiece in the reverse direction to the stamping process.

2 Claims, 5 Drawing Sheets

SPUR GEAR AUTOMATIC PRODUCTION PROCESS

BACKGROUND OF THE INVENTION

The present invention relates to a process for automatic continuous production of spur gears from coil or sheet stock.

DESCRIPTION OF THE PRIOR ART

Conventionally, the prevalent methods for press-forming spur gears include processes by hot forging, but problems arise from the lack of precise control over the temperature of the workpiece which prevents the manufacture of high precision spur gears. In addition, when spur gears are manufactured by forging, the outer diameter of the workpiece is formed, via the punch pressure, in such a way so as to conform to the protruding tooth profile of the forming die, but, under high pressure the outer diameter of said punch becomes finely worn within a short period and cannot produce high precision spur gears on a long-term basis. Thus, spur gears are also cold-press formed, but, a so-called closure is produced at the frontal edge in the direction of extrusion molding and the exterior of the spur gear anterior edge tends to become smaller while the external diameter of the posterior edge tends to becomes larger. Also, cracks may easily form in the tooth profile as shear drop occurs on the posterior edge due to extraction of the press. Although an invention is disclosed in Tokko Sho 58-47929 wherein were combined extrusion molding via a rough forming die and extrusion molding via a finishing impression, the process requires large-scale presses and the punches have a limited life span. Furthermore, a process employing a precision punch press requires an expensive and specialized press machine wherein some degree of closure will occur to the anterior and posterior surfaces of the spur gear.

SUMMARY OF THE INVENTION

An object of the present invention is to provide a process for automatically producing high precision spur gears without requiring the use of a costly specialized press machine.

A further object of the present invention is to provide a maximally efficient production process whereby high precision spur gears can be automatically produced individually in sequential operation with the vertical stroke of the press machine, the high precision gears being produced with each first or second vertical stroke of the top table.

In order to accomplish the aforesaid object, the present invention provides an automatic production process for spur gears which comprises an upper and lower table with stock fed therebetween in sequential operation with the vertical stroke of the press machine, stamping a disk-shaped gear workpiece by means of top and bottom die sets which are positioned for integrated movement in the first section, thereafter moving said gear workpiece to the second section by means of an unobstructed feed, stamping the tooth profile thereon by means of the vertical stroke of top and bottom die sets positioned in said second section, and ironing said gear workpiece in the reverse direction to the stamping direction.

According to the aforesaid construction, a lesser degree of press processing may be employed in each processing stage than when punching the tooth profile from the steel sheet in a single step because in the first section disk-shaped gear stock is precision stamped from steel sheet stock and in the second section a tooth profile is punched on said gear stock, thus, greatly reducing shear drop and cracking. Furthermore, cold-punch tapering is minimized because of ironing in the reverse direction to the tooth profile stamping direction. The present invention produces high precision spur gears individually with each first or second vertical stroke of the continuously moving press machine because the gear stock is punched in sequential operation with the vertical stroke of said press machine and an ironing process is performed in the reverse direction to the stamping direction.

Other and further objects, features and advantages of the invention will become more fully apparent from the following description.

DETAILED DESCRIPTION OF THE PREFERRED EMBODIMENTS

Figure 1:
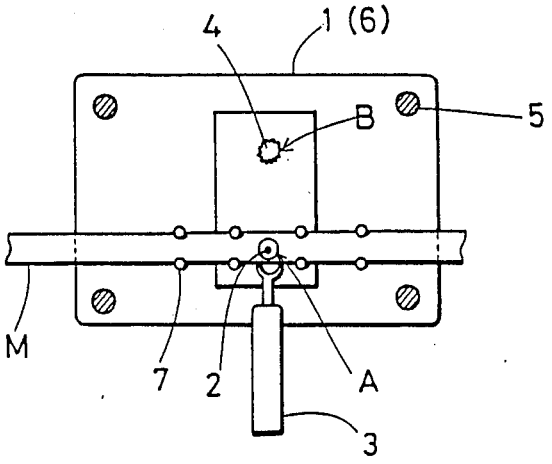
FIG. 1 is a top plan view showing a typical press machine employing an example of the process of the present invention.

An embodiment of the production process of the present invention as shown in the drawings is hereinafter described.

Figure 2:
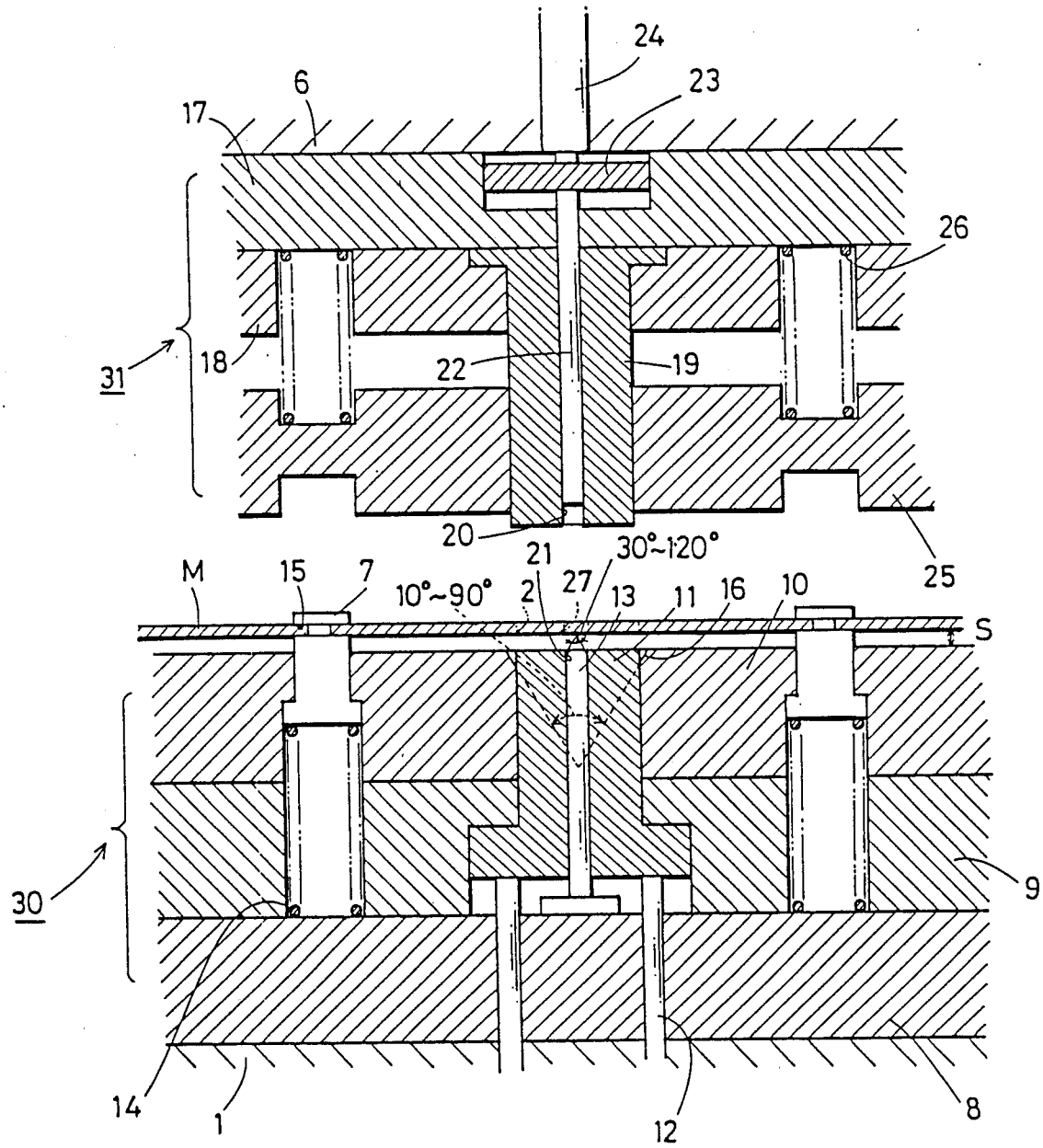
FIG. 2 is a cross sectional plan view showing the top and bottom die sets in section A.
Figure 3:
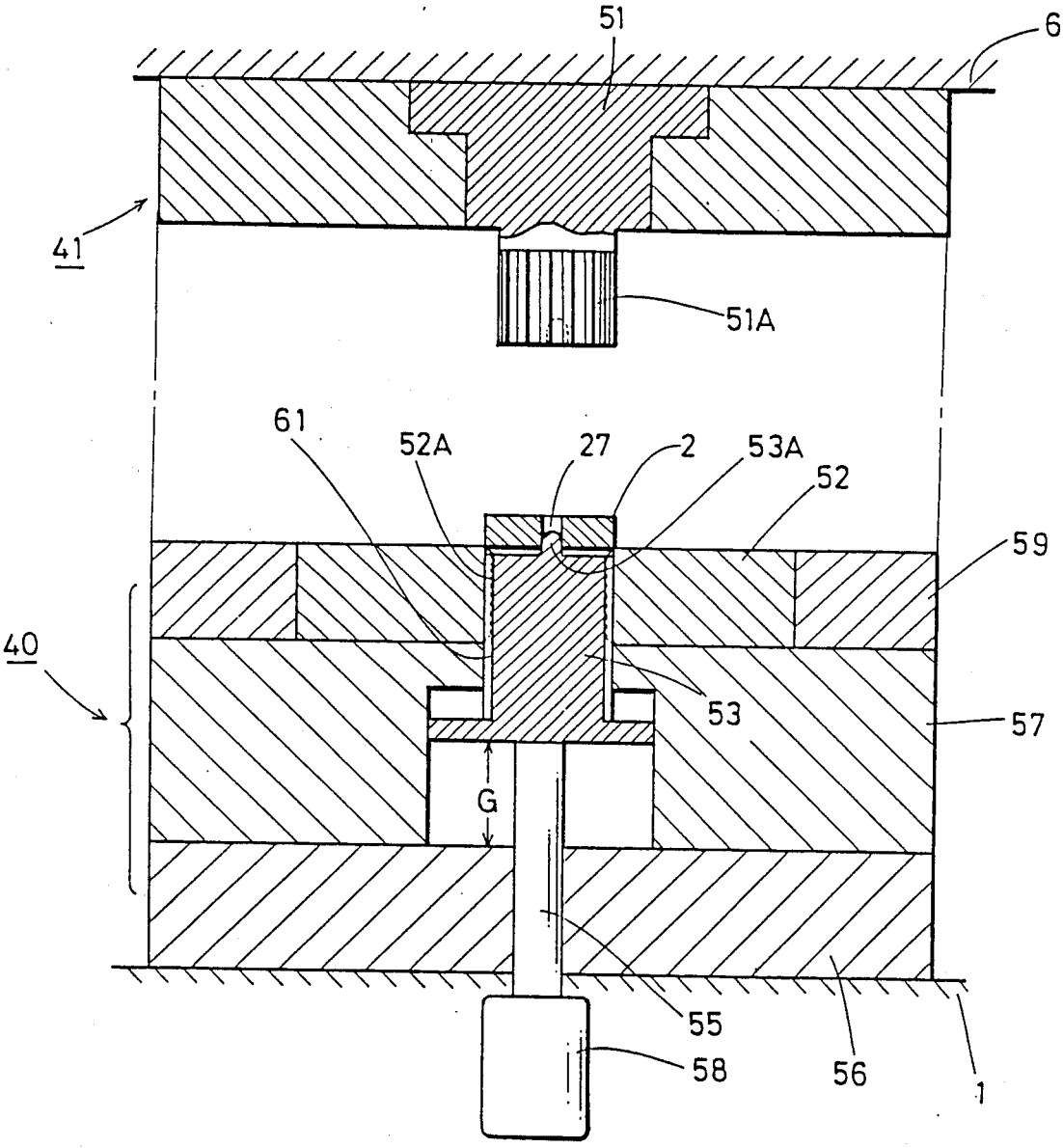
FIG. 3 is a cross sectional plan view showing the top and bottom die sets in section B.

FIGS. 1 to 3 show the construction of the press machine implementing the process of the invention. The present embodiment provides a bottom table 1 shown in FIG. 1 and a top table 6 not shown in the drawing with coil or sheet stock M fed therebetween in sequential operation to the vertical stroke of the press machine, and a disk-shaped gear workpiece 2 having a circular exterior surface and a shaft bore in its interior punched in a vertical direction by means of top die set 31 and bottom die set 30 in the first section A of the bottom table 1 as shown in FIG. 2. Then, said gear workpiece 2 travels to the second section B unobstructed by the feed for stock M by means of an air cylinder 3, cam or other means, and at the second section B tooth profile stamping and ironing processes are performed via the vertical operation of top die set 41 and bottom die set 40 producing a spur gear 4 as shown in FIG. 3. Also, referring to FIG. 1, the top table not shown in the drawing can be so connected via die post 5 as to move vertically in regard to bottom table 1. Stock M is supported by lifter pin 7 so as to be raised from bottom table 1 and the bottom die set.

The construction and operation of top die set 31 and bottom die set 30 provided in the first section A is hereinafter described with reference to FIG. 2.

As shown in FIG. 2, bottom die set 30 is mounted on the top face of bottom table 1 and top die set 31 is mounted on the underside of top table 6. Bottom die set 30 is provided to female die 10 supported by wear plate 8 and die plate 9. Outlining counter 11 is admitted to the bore of female die 10 with pressure being increased to said counter 11 in an upward direction via cushion pin 12. Minor diameter punch 13 transits the bore of outline counter 11 for the purpose of punching workpiece 2, said minor diameter punch 13 being supported by wear plate 8. Lifter pin 7 is provided to female die 10 with mobility in a vertical direction, said lifter pin 7 being upwardly projected by means of a spring 14, polyurethane rubber or other elastic material. A ring slot 15 is cut under the head of lifter pin 7 to clamp stock M. A space S of 8–20 mm is maintained between stock M and female die 10.

Chamfer 16 having an angle of 10°–90° is provided around the entire bore surface at the square inlet to female die 10, said chamfer 16 being connected to the top face and bore surface of female die 10 via a minutely curved surface. Mirroring the surface of chamfer 16 and the curved surface is desirable so as to minimize friction between stock M and said surfaces. The angle of chamfer 16 can be determined experimentally within a range of 10°–90° depending on the product. Punch 19 is mounted to top die set 31 via top die plate 17 and top punch plate 18. Punch 19 has a die bore 20 centrally drilled therein, the inlet to said die bore 20 being square. A chamfer having an angle of 30°–120° is provided at the leading edge of minor diameter punch 13. A minor diameter counter 22 is inserted through die bore 20 and the top edge of said counter 22 can be depressed by means of top knockout pin 24 through top counter plate 23. A bar stand stripper plate 25 is fitted to the exterior surface of punch 19, said stripper plate 25 being under pressure applied by a spring 26, polyurethane rubber or other elastic material with a force greater than that of spring 14.

According to the aforesaid construction, coil or cut sheet stock M is inserted in ring slot 15 under the head of lifter pin 7 and fed from the left (or right) as shown in FIGS. 1 and 2 via a stock feed device at a uniform spacing consisting of the major diameter of the product plus the dimension of the feed rail. When top table 6 descends, stripper plate 25 depresses stock M to the top face of female die 10 by means of the great pressure exerted by spring 26, etc. Also, as top table 6 descends and stock M is strongly pushed by stripper plate 25, punch 19 enters female die 10 and precision stamps gear workpiece 2 from stock M, said gear workpiece 2 separates from stock M and is moved to position above counter 11. When top table 6 rises, counter 11 is pushed upward by means of pressure from cushion pin 12. Furthermore, because stock M returns to the position shown in FIG. 2 via lifter pin 7, gear workpiece 2 remains in space S between stock M and counter 11.

Shaft bore 27 centered on workpiece 2 is precision punched by the insertion of minor diameter punch 13 into the die bore of punch 19 when punch 19 previously entered female die 10. Punch debris from shaft bore 27 of workpiece 2 enters die bore 20 of punch 19 when outline counter 11 depresses cushion pin 12 and descends into female die 10. Thereupon, the debris which entered die bore 20 of punch 19 is expelled from die bore 20 because minor diameter counter 22 is depressed by top knockout pin 24 via top counter plate 23 when top table 6 rises to its highest level, said debris then being removed by a compressed air or exhaust device. The dies in section A are advantageous in that the dimensions of the feed rail can be as much as the plate thickness of stock M since the bar stand stripper plate 25 is provided.

Gear workpiece 2 is moved to the dies in section B by means of an air cylinder 3, cam or other means.

The construction and operation of the section B dies are hereinafter described with reference to FIGS. 3 through 6. As shown in FIG. 3, punch 51 of die set 41 is mounted to the underside of top table 6, and on the bottom exterior surface of said punch 51 is formed tooth profile 51A. Also, counter plate 56 of bottom die set 40 is attached to the top face of bottom table 1 and the interior of female die 52, which is positioned above counter plate 56 via wear plate 57, has formed thereon tooth profile 52A having the required modular shape. Counter 53 for receiving gear workpiece 2 transits female die 52, the length of counter 53 being determined so as to form a gap G situated between the underside of counter 53 and the top face of counter plate 56. In the present embodiment, counter 53 has an exterior surface with a tooth profile 61 notched thereon. The length of gap G is set at a value such that even when counter 53 attains its end point of descent it does not make contact with counter plate 56. Abutting the underside of counter 53 is ejector pin 55 having at its bottom portion a gas or hydraulic cylinder-actuated pressure device 58 with two-stage switching capability provided thereto. Ejector pin 55 normally moves upward under reasonable pressure of approximately 2–50 t provided by pressure device 58, said pressure device 58 being capable of supplying a great pressure some 5–10 fold greater when workpiece 2, which thereafter becomes partially fabricated item 70, enters female die 52 under pressure from counter 53. Reinforcing ring 59 is shrinkage fitted on the exterior surface of female die 52. The press machine used in the present embodiment is of a typical type, modified only in that pressure device 58 is provided thereto.

Figure 4:
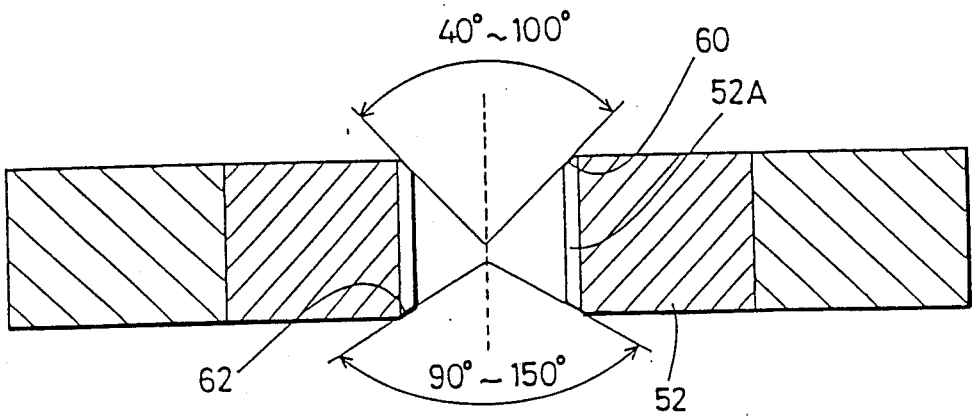
FIG. 4 is a cross sectional plan view showing an enlargement of the female die.

A 40°–100° chamfer 60 is achieved with uniformity around the entire circumference of the inlet to female die 52 as shown in FIG. 4 in order to markedly reduce the frictional resistance at the inlet to female die 52 since female die 52 or punch 51 can be easily damaged due to the great force exerted when the tooth profile is formed at the inlet to female die 52, also chamfer 60 must be attached to both the vertical and horizontal surfaces of female die 52 via the minutely curved surface of the diameter. Because the angle of chamfer 60 may be changed according to the thickness of the workpiece 2, appropriate angles in the range of 40°–100° can be determined through experimentation. Also, in order to avoid a concentration of pressure, it is desirable that chamfering 60 and the minutely curved surface be specially mirrored surfaces. A 90°–150° chamfer 62 is provided to the bottom inlet to female die 52.

Gear workpiece 2, which is precision press-punched in the section A process, is used to manufacture a spur gear by means of the process of the embodiment in the aforesaid construction. In this embodiment a shaft bore 27 is punched in the center of workpiece 2. First, workpiece 2 is placed on counter 53. Positioning of workpiece 2 is determined by matching shaft bore 27 with shaft 53A of counter 53. When top table 6 descends, descending punch 51 applies a downward pressure and counter 53 applies an upward pressure via pressure device 58 on workpiece 2 which is situated therebetween, said workpiece 2 receiving pressure in both upward and downward directions is pushed via the great pressure from above exerted by punch 51, and since the pressure exerted from above by punch 51 is greater than the pressure exerted from below by counter 53 said workpiece 2 is admitted to female die 52 while generating some punch debris. Although a large force is exerted at this time on the inlet to female die 52, because chamfer 60 is provided thereto connected by a curved surface to the inlet of female die 52, workpiece 2 can transit chamfer 60 with comparatively slight frictional resistance. Workpiece 2 transits chamfer 60 of female die 52, is forced completely into said female die 52, and punch 51 descends so as to complete the transit of workpiece 2 through female die 52. A comparatively slow speed of descent for punch 51 is most suitable for forming the tooth profile. At such time as punch 51 attains the end point of descent, the underside of counter 53 makes contact with the top face of counter plate 56 via the force exerted by said punch 51, and since punch 51 can be easily damaged should sufficient force be applied, the aforesaid gap G is provided in order that such damage may be avoided and assure there is no contact between counter 53 and counter plate 56. Punch 51 rises after attaining the end point of descent.

Figure 5:
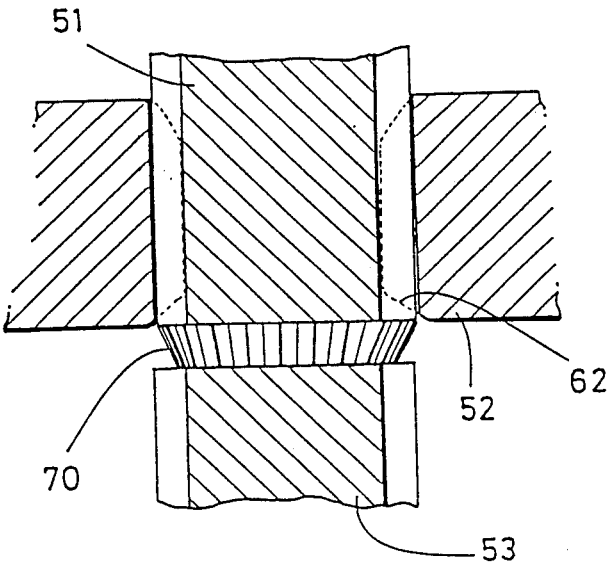
FIG. 5 is a cross sectional plan view showing the female die and the partially fabricated item after completion of the downward stroke and prior to the upward stroke.
Figure 6:
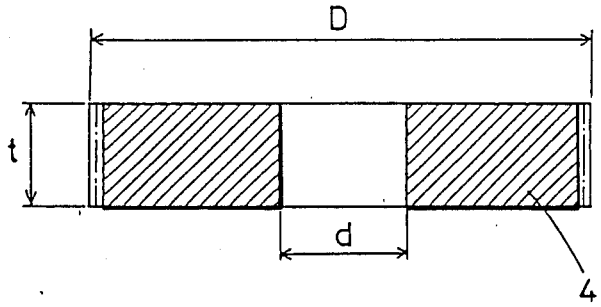
FIG. 6 is a cross sectional plan view showing production of the spur gear.

A high precision spur gear is difficult to produce because partially fabricated item 70, having a tooth profile punch-formed via pressure exerted by the aforesaid punch 51, has some trimming taper affixed thereto as shown in FIG. 5 and its exterior diameter may expand 5% due to springback. Thus, by switching pressure device 58, which has a two-stage switching capability, to high-pressure operation and with partially fabricated item 70 positioned on counter 53, vertical pressure is applied via punch 51 and counter 53 in reverse orientation to the aforesaid downward motion, partially fabricated item 70 is forced into female die 52 via the great pressure exerted in the opposite direction by counter 53, and said item 70 is moved upward to remove the trimming taper by transiting said female die 52 in an upward direction. During this upward movement, the slight slant face of chamfer 62 at the bottom inlet to female die 52 works effectively, and partially fabricated item 70 having a trimming taper thereon is smoothly inserted into female die 52 via counter 53, ironing and deburring operations are performed, and as shown in FIG. 6 a high precision spur gear 4 with the trimming taper removed is individually produced with each vertical stroke of punch 51 and counter 53.

(Example of Numerical Performance)

A high precision spur gear which meets the JIS (Japanese Industrial Standards) fourth class requirements can be manufactured by means of the aforementioned process, said spur gear having an outer diameter D of 30 mm, inner diameter d of 6 mm and length t of 6 mm as shown in FIG. 5. Surprisingly high precision spur gears are produced which can even be used for automobile transmission gears where normal requirements are JIS classes 6–7.

(Other Embodiments)

Figure 7:
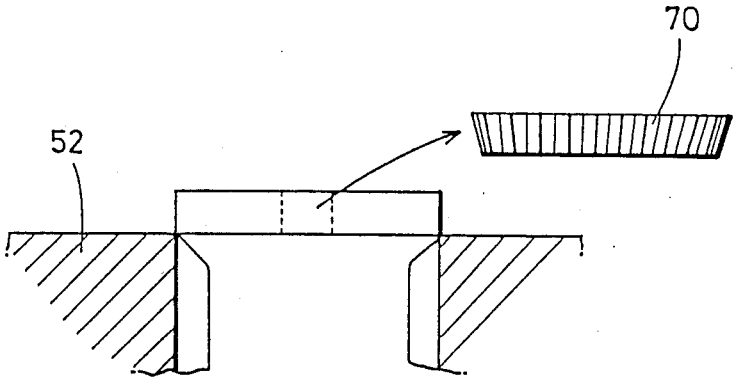
FIGS. 7 and 8 are cross sectional plan views showing further examples.
Figure 8:
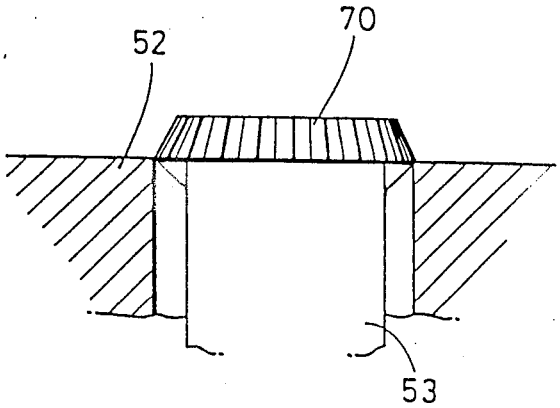

In the aforesaid embodiment a tooth profile is formed between each vertical stroke of punch 51 and counter 53 in section B, however, a high precision spur gear 4 without shear drop as shown in FIG. 6 may also be produced on the second vertical stroke of top table 6 in the following manner: A tooth profile is formed on gear workpiece 2 by its insertion into die 52 during the downward stroke of punch 51 and counter 53, and after partially fabricated item 70 having a trimming taper formed thereto as shown in FIG. 7 is ejected to the top face of die 52 via the upward stroke, said item 70 is inverted, its orientation reversed as shown in FIG. 8. According to this process a spur gear 4 can be produced with every second vertical stroke of top table 6.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A method of automatically producing a spur gear through cold-press forming, comprising the steps of:

stamping a disk-shaped workpiece from a stock material at a first section of a bottom table, said stamping being performed by an upper die and a bottom die at the first section of the bottom table, said workpiece being formed with a diameter substantially equal to the diameter of a finished spur gear;

removing said workpiece from said stock material and transporting the removed workpiece along said bottom table to a second section of the bottom table separate from said first section;

pressing the workpiece with a punch from an upper position to a lower position through a female die which defines a tooth profile and which includes upper and lower inlets, the upper and lower inlets each having a mirrored surface and being provided with a chamfer; and extruding the workpiece toward the upper inlet of the female die from the lower position with a counter.

2. A method of automatically producing a spur gear through cold-press forming, comprising the steps of:

stamping a disk-shaped workpiece from a stock material at a first section of a bottom table, said stamping being performed by an upper die and a bottom die at the first section of the bottom table, said workpiece being formed with a diameter substantially equal to the diameter of a finished spur gear and having a central axis extending in a direction perpendicular to the disk-shaped surfaces of the workpiece;

removing said workpiece from said stock material and transporting the removed workpiece along said bottom table to a second section of the bottom table separate from said first section;

loading the workpiece in a first orientation on a counter located in a bore of a female die at the second section, said female die including an upper inlet which has a mirrored surface and a chamber, said bore defining a tooth profile;

pressing the workpiece with a punch from an upper position to a lower position through the chamfer into the female die to produce a primary product;

extracting the primary product from the female die with the counter;

reversing the orientation of the primary product about a plane perpendicular to the central axis of the workpiece;

loading the primary product on the counter;

pressing the primary product with the punch into the female die; and removing a resultant spur gear from the die with the counter.

* * * * *